US005862528A

United States Patent [19]

Saijo et al.

[11] Patent Number: 5,862,528

[45] Date of Patent: Jan. 26, 1999

[54] SAFETY HELMET AND A HEAD PROTECTOR THEREFOR

[75] Inventors: Yoshiaki Saijo; Noboru Oikawa, both of Iwate-ken, Japan

[73] Assignee: Shoei Kako Co., Ltd., Tokyo, Japan

[21] Appl. No.: 742,886

[22] Filed: Nov. 1, 1996

[30] Foreign Application Priority Data

Nov. 1, 1995 [JP] Japan ..... 7-285150

[51] Int. Cl.[6] ..... A42C 5/04; A42B 3/00

[52] U.S. Cl. ..... 2/411; 2/425

[58] Field of Search ..... 2/411, 410, 414, 2/425, 412, 413, 171.3

[56] References Cited

U.S. PATENT DOCUMENTS 4,434,514 3/1984 Sundahl et al. ..... 2/425

5,272,773 12/1993 Kamata ..... 2/425 X 5,351,341 10/1994 Broersma ..... 2/425

5,450,631 9/1995 Egger ..... 2/171.3

*Primary Examiner*—Gloria M. Hale

*Attorney, Agent, or Firm*—Parmelee & Bollinger LLP

[57] ABSTRACT

A head protector for a helmet, in which at least one groove is provided in a predetermined inner surface of an impact-on-the head absorbing liner, the predetermined inner surface including at least a top portion to face the vertex of a person with a helmet on, but not substantially including at least a front portion to face the person's sinciput and a plurality of projections at least partially surrounded by the groove are provided in the predetermined inner surface. Owing to this head protector, the rigidity of the whole of the impact-on-the-head absorbing liner is not worthlessly reduced and, nevertheless, both the maximum acceleration and HIC due to an impact are effectively reduced.

22 Claims, 10 Drawing Sheets

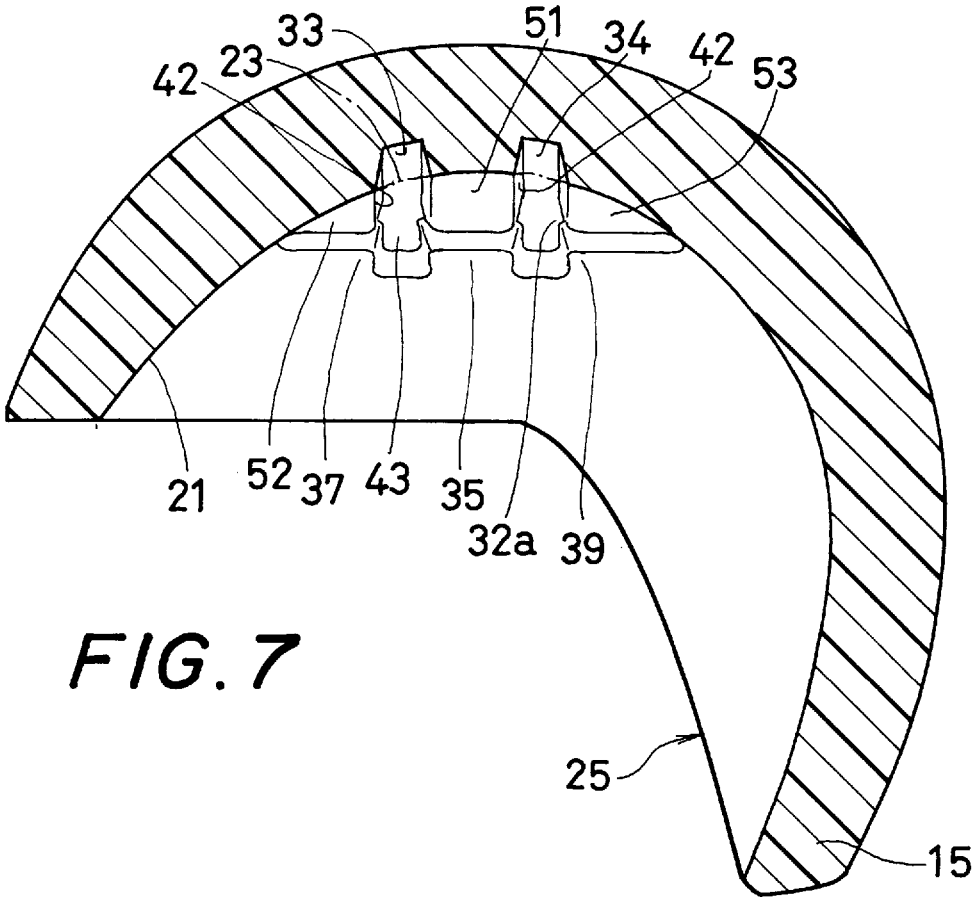
FIG. 7
FIG. 8
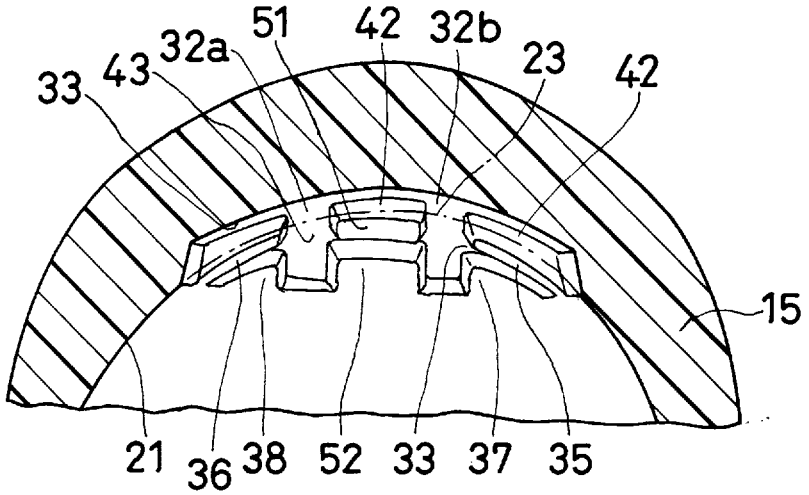

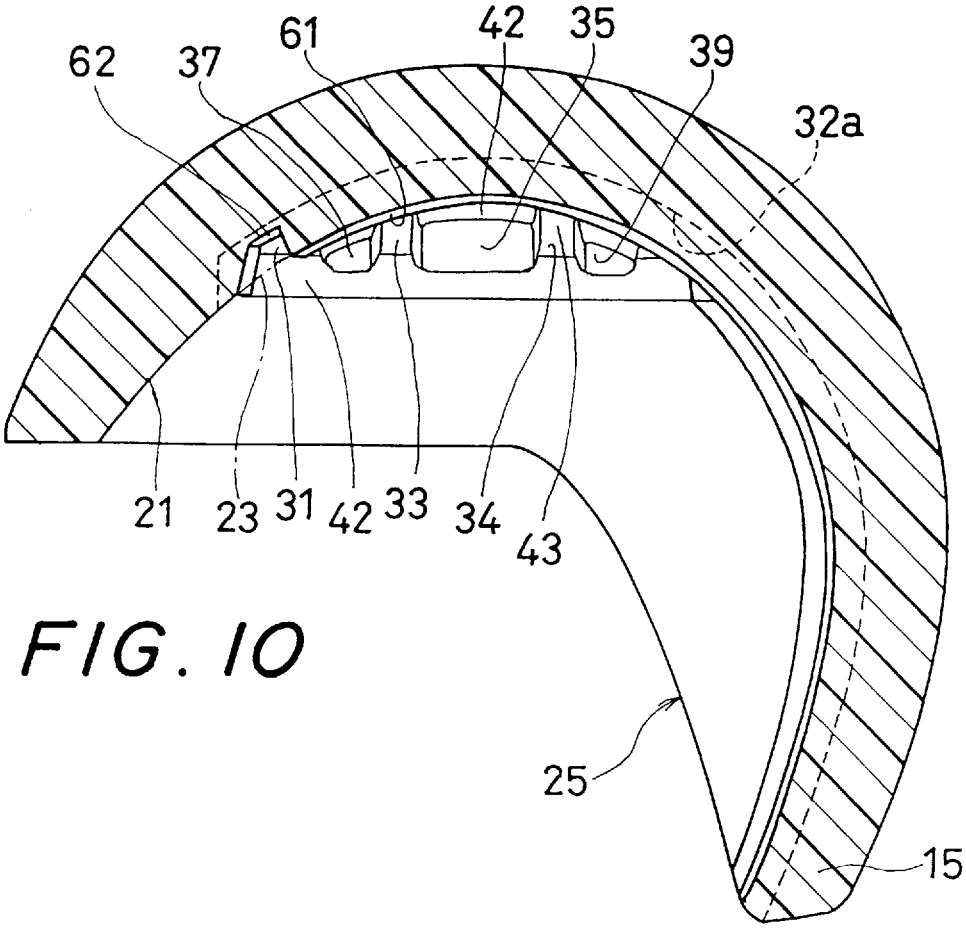
FIG. 10
FIG. 11
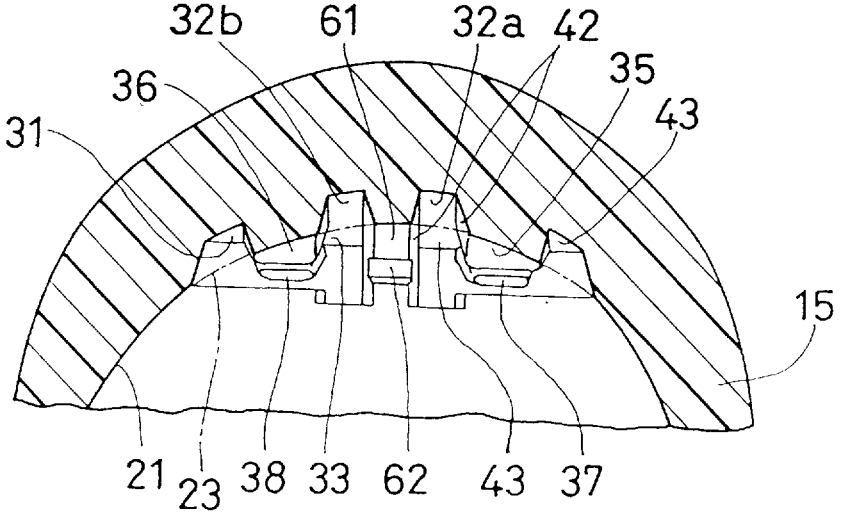

SAFETY HELMET AND A HEAD PROTECTOR THEREFOR

TECHNICAL FIELD

Safety helmets are well-known, such as those known as jet-type, semi-jet-type, or full-face-type. They include a head protector (hereinafter in this text called "head covering") which is used to protect the head of a man with a helmet on, such as a rider on a motor-bicycle.

BACKGROUND OF THE INVENTION

Well-known is a safety helmet, such as jet-type one, semi-jet-type one or full-face-type one, which includes a head protector (hereinafter described in this text only as "head covering"), which is used to protect the head of a man with a helmet on, such as a rider on a motor-bicycle (they are hereinafter described as "a rider or the like"). The conventional jet-type, semi-jet-type, or full-face-type helmet has generally a head covering and a pair of right and left chin straps, which are secured on the inside of the head covering, and typically constituted as follows.

The head covering has a cut (in the case of the jet-type or semi-jet-type helmet) or an opening (in the case of the full-face-type helmet), which is formed in the front of a part between the forehead and the chin (that is, the face). The jet-type or the semi-jet-type helmet further has a visor, which is secured to the head covering adjacent to the upper edge of the recess. The full-face-type helmet further has a shield plate, which is secured to the head covering so as to be movable between a lower position, where it closes the opening, and a upper position, where it opens the opening. The shield plate can be used for the jet-type helmet and the semi-jet-type helmet, for example in lieu of the visor. In that event, the shield plate can open and close the recess.

The head covering comprises an outer shell, which forms the outer peripheral wall of the head covering; a rim member; and a backing member, which is brought into contact with the inner surface of the outer shell and fixed by adhesive or the like. The rim member is fixed to the rim of the outer shell by adhesive or the like, so that all the rim of the outer shell (in the case of the full-face-type helmet, all the rim of the opening is also included) is put between the rim member. The backing member includes a backing member for the head, which is to face the sinciput, the vertex, the temples and the occiput. The backing member of the jet-type or the semi-jet-type helmet further includes two backing members for the two ears, each of which is to face the ears, or the backing member for the head is integral with backing members for the ears. The backing member of the full-face-type helmet further includes a backing member for the chin, which is to face to the chin.

The backing member for the head comprises an impact-on-the-head absorbing liner and an air permeable back cover. The back cover for the head is secured to the impact absorbing liner by an adhesive or a tape so that the back cover for the head covers the inner surface of the impact absorbing liner (sometimes, an area facing the vertex of the rider or the like's head is partially excluded), the side surface (that is, a narrow surface lying between the inner surface and the outer surface), and the periphery of the outer surface which extends from the side surface. The impact absorbing liner is made of foamed synthetic resin, such as polystylene, polypropylene or polyethylene. The backing member for the jaw also has substantially the same structure as that of the backing member for the head except for having such a shape as to correspond to the rider jaw. If necessary, a pair of right and left block-shaped inner pads are attached on a part of the inner surface of the impact-on-the-jaw absorbing liner (for example, two areas to face the rider's cheeks). Thus, this blockish inner pad is positioned between the impact-on-the-jaw absorbing liner and the back cover for the jaw. The backing member for each ear also has substantially the same structure as that of the backing member for the head or jaw except for having such a shape as to correspond to the rider ear.

When impact is exerted on a part of the outer shell of the conventional safety helmet typically constituted as above, the impact is widely dispersed throughout the outer shell and the impact energy is absorbed by the deformed outer shell. Further, the impact absorbing liner functions in absorbing the impact energy propagated from the outer shell by means of its deformation, absorbing the impact energy by means of its thickness reduction (that is, compressive deformation), and lowering the maximum acceleration due to the impact by means of delaying the propagation of this impact energy exerted on the rider head. In this text, the "maximum acceleration" means the maximum value of the acceleration through an impact absorbing test for the helmet.

Up to nowadays, the above impact absorbing test has been made to ascertain the protective characteristic of the safety helmet. In this impact absorbing test, a metallic head model imitating the head of a man with a helmet on is used, in which an accelerometer is incorporated. A standard on the maximum acceleration measured with the accelerometer has been adopted in each country. Further, an index of HIC (Head Injury Criteria) has been proposed on the basis of correlation between the mean acceleration value of a certain duration and the duration of the appearances of values continuously over this mean acceleration value, and the brain damage. HIC is given by:

$$HIC = \left( \frac{1}{t2 - t1} \times \int_{t1}^{t2} a(t)dt \right)^{2.5} \times (t2 - t1)$$

where a(t) is the change of acceleration value with time during the impact absorbing test, and $t_1$, $t_2$ are the time, each maximizing the HIC value.

The HIC value has been considered to have good correlation with the level of the injuries suffered in an accident. According to Mr. P. D. Hope of Transport and Road Research Laboratory established in England, in an accident on the motor-bicycle, when the HIC value is 1,000, the probability of mortality is 8.5%; when the HIC value is 2,000, the probability of mortality is 31%; and the HIC value is 4,000, the probability of mortality is 65%. Therefore, it is necessary to lower the HIC value in order to lower the level of the injuries.

As described above, it is necessary to lower the maximum acceleration value and the HIC value due to the impact, if it is desired to improve the protective characteristic of the safety helmet. Such being the case, in order to lower the maximum acceleration value and the HIC value, the thickness of the impact absorbing liner has been increased so far.

However, only to increase the thickness of the impact absorbing liner is insufficient for the reduction of the maximum acceleration value and, particularly, difficult for the reduction of the HIC value. The HIC value includes the duration of the appearances of values continuously over a specific acceleration value, so that even if the maximum acceleration value is a little lowered due to a cushion characteristic of the impact absorbing liner, it is impossible to shorten the duration of the appearances of values continuously over the specific acceleration value. Thus, it is impossible to reduce the HIC value.

SUMMARY OF THE INVENTION

Accordingly, it is a main object of the present invention to provide a head covering for a safety helmet in which both maximum acceleration values and HIC values caused by an impact are effectively lowered without reducing particularly the rigidity of an impact-on-the-head absorbing liner.

In accordance with an aspect of this invention, in a head protector for a safety helmet, which comprises an outer shell made of hard material and an impact-on-the-head absorbing liner arranged on the inside of the outer shell, at least one groove is provided in a predetermined area of the inner surface of the liner, the predetermined area including at least a top portion facing the vertex of a person with a helmet on but not substantially including at least a front portion facing the person's sinciput. Thereby, a plurality of projections at least partially surrounded by the grooves are provided in the predetermined area. According to this invention, in the five areas of the impact-on-the-head absorbing liner (that is, the front portion, the top portion, the right and left portions and the back portion), the front portion with the lowest strength has substantially no groove and the top portion with the highest strength has the groove, so that the plurality of projections can be provided on the inner surface of the liner without reducing particularly the rigidity of the impact-on-the-head absorbing liner.

In a preferred embodiment of this invention, the groove may vary in shape, for example, a vertical groove, a lateral groove, an oblique groove, a closed-curve groove or an opened-curve groove and, in number, may be single or plural. When only one groove is disposed, the groove may be complicated in shape like a line drawn with a single stroke and, thereby, obtain a plurality of projections. Such projections may be various in shape, for example, blockish projections, extending projections, island-type projections, peninsula-type projections, cape-type projections, or bridge-type projections.

In another preferred embodiment of this invention, it is preferable that the number of the projections is 4 to 60, particularly, it is much better that the number is 6 to 30. As the number of the projections is larger or smaller than the above-described range, bad results will be brought. The smaller the number is, the less the effect of the projection is, and the larger the number is, the manufacture of the head protector becomes more difficult.

The above, and other, objects, features and advantages of the present invention, will become readily apparent from the following detailed description thereof which is to be read in connection with the accompanying drawings.

BRIEF DESCRIPTION OF THE DRAWINGS

FIG. 7 is a longitudinal sectional view taken along the line D—D on FIG. 6;

FIG. 8 is a longitudinal sectional view taken along the line E—E on FIG. 6;

FIG. 10 is a longitudinal sectional view taken along the line F—F on FIG. 9;

FIG. 11 is a longitudinal sectional view taken along the line G—G on FIG. 9.

DETAILED DESCRIPTION OF THE INVENTION

Figure 1:
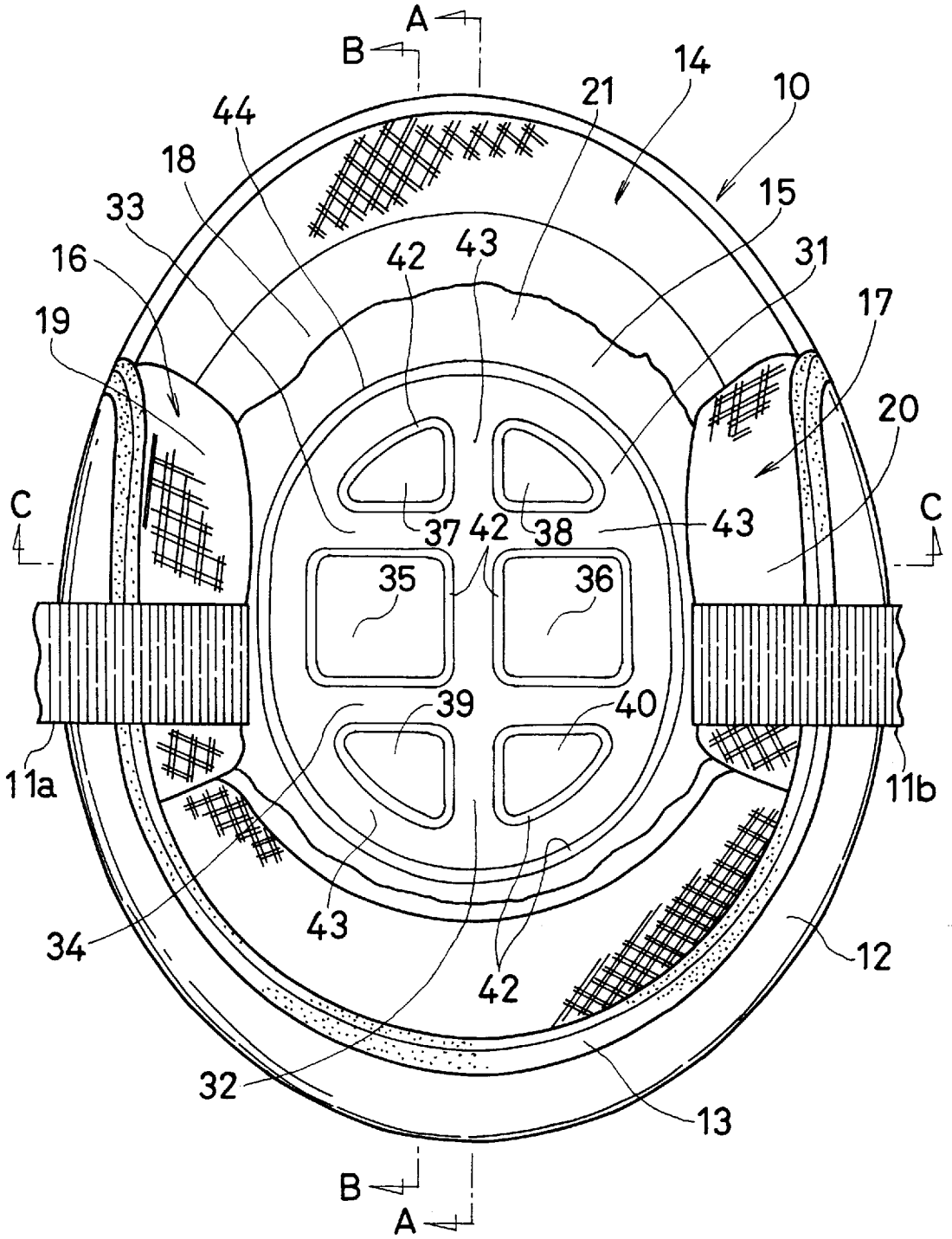
FIG. 1 is a bottom view of a head covering according to one embodiment of this invention, the back cover thereof being partly broken away and both base portions of a pair of right and left chin straps being added.
Figure 2:
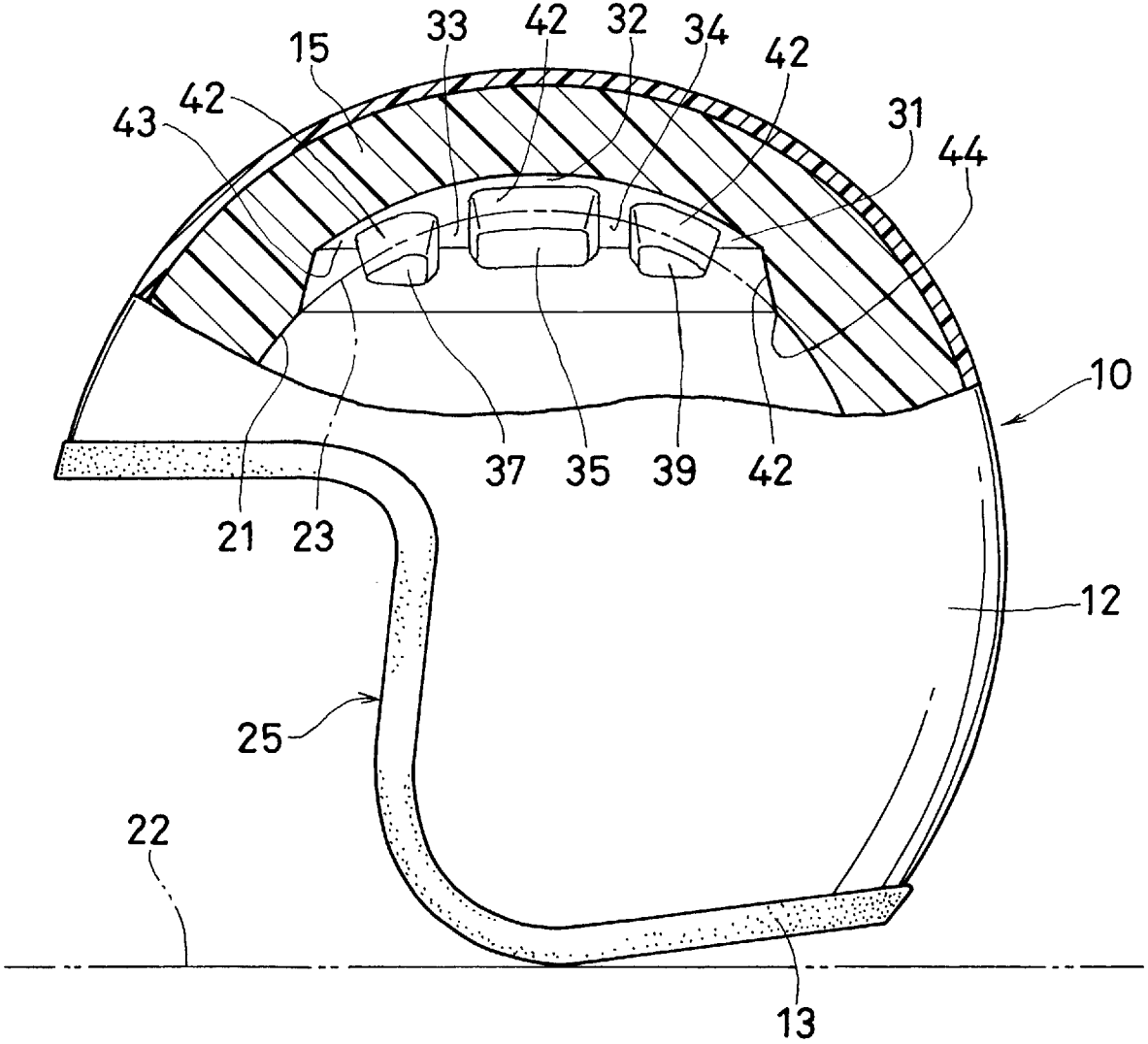
FIG. 2 is a right side view, partly in section, of the head covering shown in FIG. 1, the back cover thereof being omitted and the upper portion thereof being shown by a longitudinal sectional view taken along with the line A—A on FIG. 1.
Figure 3:
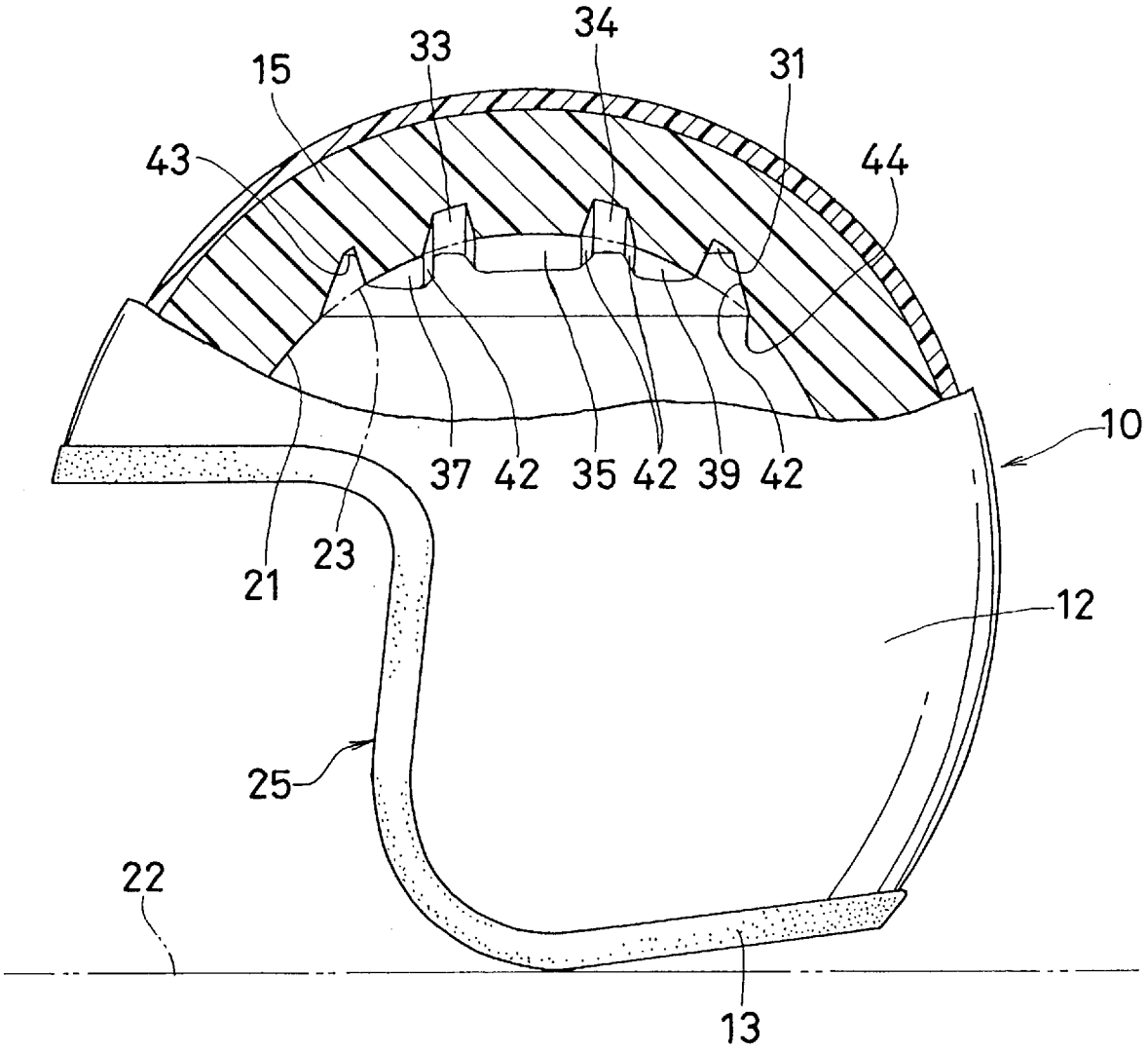
FIG. 3 is a right side view, partly in section, of the head covering shown in FIG. 1, the back cover thereof being omitted and the upper portion thereof being shown by a longitudinal sectional view taken along with the line B—B on FIG. 1.

Firstly, a head covering shown in FIGS. 1–5 according to a first embodiment of this invention will be hereinafter described. As shown in FIGS. 1–3, this head covering 10 is used for making up a jet-type safety helmet, so that this helmet has not only the head covering 10 but also a pair of right and left well-known chin straps 11*a*, 11*b*, the base ends of which are secured on the inside of the head covering 10, respectively. The helmet may also have a well-known visor or a well-known shield plate (not shown). Shown in FIGS. 2 and 3 is the head covering just at the time when a rider with the helmet on is in an ordinary stance (in this text, described hereinafter as "the head covering worn in the ordinary stance").

As shown in FIGS. 1–3, the head covering 10 comprises a domelike outer shell 12 forming the outer peripheral wall thereof; the hereinbefore described well-known rim member 13; a backing member 14 for the head fixed on the inside of the outer shell 12 by adhesive or the like; and backing members 16, 17 for the right ear and the left ear.

The feature of this invention is in the groove structure formed in an impact-on-the-head absorbing liner 15, and the other structures may be the same as those used in the hereinbefore described well-known helmet, so that the description of the other structures will be ungiven except as necessity arises.

When an impact is exerted on a part of the outer shell 12, the impact must be widely dispersed throughout the outer shell and the impact energy must be absorbed due to the deformation of the outer shell 12, so that the outer shell 12 should have high rigidity and high breaking strength. Thus, the outer shell 12 may be made from strengthened rigid resin obtained by curing a mixture of reinforcing material, such as glass fiber, carbon fiber, high strength organic fiber or the like, and thermoset resin, such as unsaturated polyester resin, epoxy resin or the like. The outer shell 12 may also be made from strengthened rigid resin obtained by hot forming of a mixture of the above reinforcing material and thermoplastic resin, such as polycarbonate or the like. Further, the outer shell 12 may also be made from composite material obtained by backing those rigid resins with a soft sheet like an unwoven fabric sheet.

It is preferable that the thickness of the outer shell is 1–6 mm and it is much preferable that the thickness is 2–5 mm. It is not desirable that the thickness is outside the above range. That is, the smaller the thickness is, the lower the rigidity of the outer shell 12 is, and the larger the thickness is, the heavier the outer shell 12 is.

The backing member 14 for the head may have a shape abutting substantially on the whole of the inner surface of the outer shell 12 but, in the first embodiment, the backing member 16 for the right ear and the backing member 17 for the left ear may be formed separately therefrom as shown in FIG. 1. In the case of the latter, the backing member 14 for the head has such a shape as to have portions, which face the inner surface of the outer shell 12 and yet face each of the rider's right and left ears.

The backing member 14 for the head shown in FIG. 1 comprises an impact-on-the-head absorbing liner 15, which has such a shape as to have portions, which face the inner surface of the outer shell 12 and yet face each of the rider's right and left ears, and an air permeable back cover 18 for the head, which covers the inner surface of the liner 15. In FIGS. 1–3, this back cover 18 for the head is cut off and omitted in the range corresponding to the top portion of the liner 15, which is to face the rider's vertex.

The backing member 16 for the right ear and the backing member 17 for the left ear comprise an impact absorbing liner for the right ear and an impact absorbing liner for the left ear (both are not shown); a blockish inner pad for the right ear and a blockish inner pad for the left ear (both are not shown) provided on the inner surfaces of the respective impact absorbing liners, and made of flexible elastic material like urethane foam, other synthetic resin or the like; and an air permeable back cover 19 for the right ear and an air permeable back cover 20 for the left ear which cover not only those pads but also the respective impact absorbing liners for the right and left ears from the inner surface sides thereof. The pair of right and left chin straps 11*a*, 11*b* described hereinbefore are secured to the backing members 16, 17 for the right and left ears, respectively.

The impact-on-the-head absorbing liner 15 must be deformed to absorb the impact energy propagated from the outer shell 12, and must reduce its thickness to absorb the impact energy and to delay transmission of the impact energy to the rider's head, so that the liner 15 should have a suitable plastic deformation rate and a suitable elastic deformation rate. Therefore, it is preferable that the liner 15 is made of synthetic resin foam, such as polystyrene foam, polypropylene foam, polyethylene foam or the like. The density of the foam affects its impact energy absorbing ability and its impact energy transmitting ability. It is preferable that the density of the impact-on-the-head absorbing liner 15 is generally within a range of 20–80 g/lit. It is much preferable that the density is within 30–70 g/lit. As the density of the liner 15 exceeds the upper limit of the above range, the ability of the liner 15 to absorb the impact energy exerted on the outer shell 12 becomes less, so that most of the impact energy is transmitted directly to the rider's head. Such being the case, the maximum acceleration exerted on the head becomes large and the protection effect of the helmet becomes insufficient. As the density of the liner 15 exceeds the lower limit of the above range, the ability to absorb the impact energy becomes more, but the deformation of the liner 15 due to the impact becomes very large so that the liner 15 is easily damaged.

Particularly, if the lower density liner 15 is collided with a spherical or dully peaked object, the impact energy transmitted from the outer shell 12 to a portion of this liner 15 is not widely dispersed effectively but exerted on a highly limited area of the liner 15, so that the liner 15 is deformed and compressed (that means the reduction of its thickness) within the highly limited area. Thus, a so-called bottoming phenomenon occurs and a large force is exerted on the head. To prevent this bottoming phenomenon from occurring, it is necessary to increase the thickness of the impact absorbing liner 15 but, if the thickness increases, the head covering 10 becomes too large, so that it becomes difficult to wear the helmet, or the wind pressure exerted on the helmet rises. It will hurt its utility. Such being the case, it is preferable that the thickness of the impact absorbing liner 15 is 15–55 mm and it is much preferable that the thickness is 25–45 mm.

The above description of the material and density of the impact-on-the-head absorbing liner 15 is applicable to those of the impact absorbing liners for the right and left ears.

The head covering 10 has five areas: a front portion to face the rider's sinciput, a top portion to face the rider's vertex, right and left side portions to face the rider's right and left temples, and a rear portion to face the rider's occiput, and the top portion of the liner 10 is substantially of hemispherical shape and connected to the front portion, the right and left portions and the rear portion, so that the strength of the top portion is highest among all the portions. In the case of the all type helmets: the jet-type, the semi-jet-type and the full-face-type helmets, the rear portion of the head covering 10 extends much downwards and is connected to the top portion and both the right and left portions, so that it has the second strength among the all. As stated before, the front portion of the head covering 10 has the cut 25 or the opening and, as the case may be, has a ventilation mechanism, so that its strength is lowest. Further, the right and left side portions of the head covering 10 are located adjacent to the cut 25 or the opening, so that its strength is higher than the one of the front portion but considerably lower than the one of the rear portion.

As described above, the top portion of the conventional head covering 10 has the highest strength and is of hemispherical shape, so that it is not deformed effectively due to the impact energy transmitted from the outer shell 12. Thus, when an impact test is made under the same condition, the maximum acceleration value and the HIC value of the top portion tends to be higher than the ones of the other portions (the front portion, the right and left portions and the rear portion). Therefore, to disperse the impact energy exerted on the head covering 10; to make it absorb effectively and, thereby, to reduce its maximum acceleration value and its HIC value, it is necessary that, in the top portion of the head covering 10, the impact absorbing liner 15 is deformed due to the impact so as to disperse the impact energy and make the liner 15 absorb it, and the thickness of the liner 15 is effectively reduced so as to enable the liner 15 to absorb effectively the impact energy.

Figure 5:
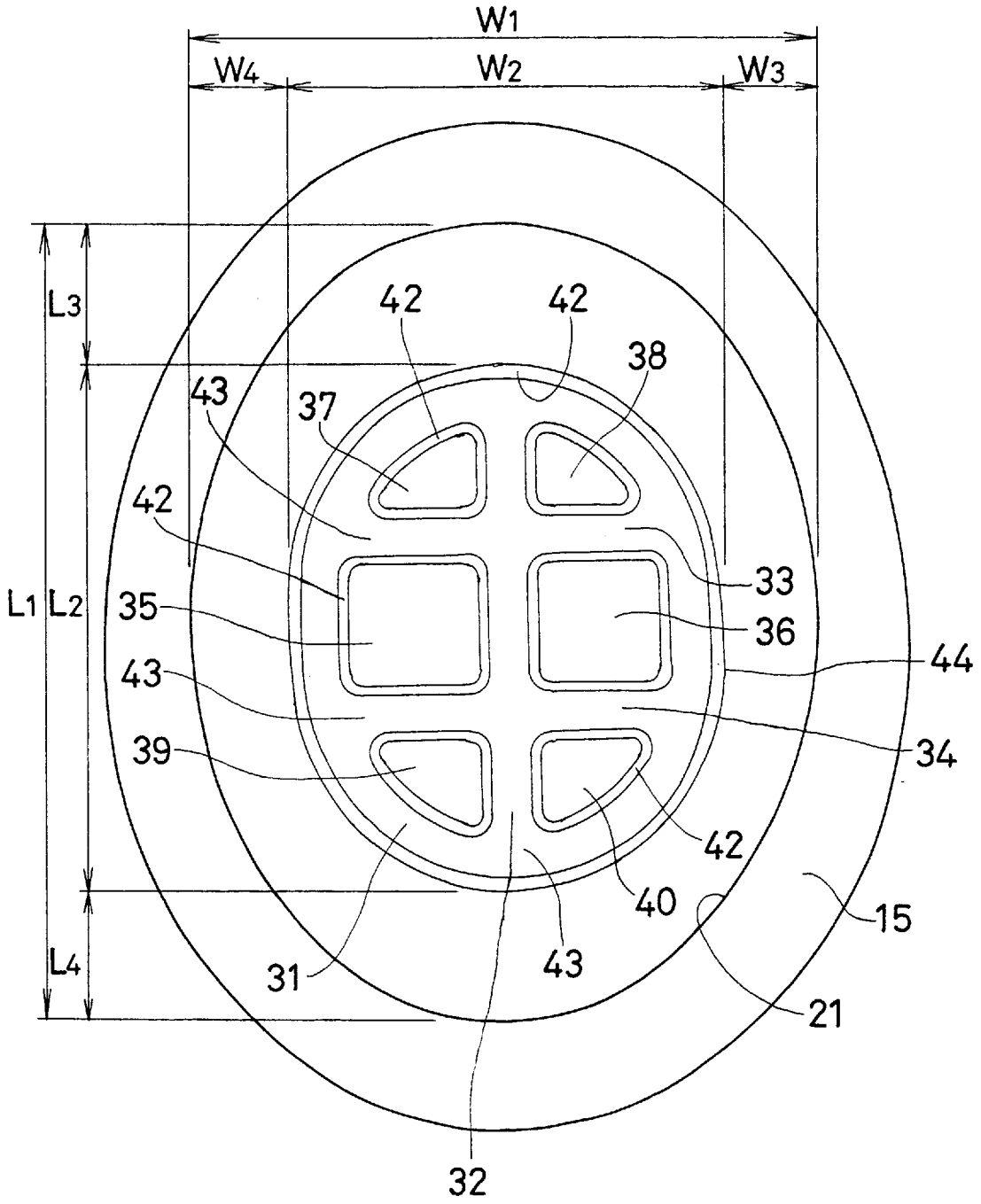
FIG. 5 is a projection representation, projected on the horizontal plane, of the bottom surface of the impact-on-the-head absorbing liner shown in FIGS. 1–3.

In a first embodiment in accordance with the present invention, the following elements are provided substantially on the inner surface of the top portion of the impact absorbing liner 15 as shown in FIGS. 1 and 5.

(1) outer groove 31 formed substantially into an ellipse or an elongated circle, whose major axis is in alignment with the longitudinal axis of the head covering 10 and, in other words, having substantially an endless shape (that is, a closed curve);

(2) a longitudinal groove 32 extending substantially straight along the major axis of the outer groove 31 and in the longitudinal direction of the head covering 10, with both ends being connected with the outer groove 31; and (3) lateral grooves 33, 34 extending substantially perpendicularly to the longitudinal groove 32 so as to divide the longitudinal groove 32 substantially into three equal parts and, in other words, extending substantially straight in the lateral direction of the head covering 10, with both ends being connected with the outer groove 31. Thus, the outer groove 31 extends endlessly so as to be able to sequentially connect the respective ends of the longitudinal groove 32 and the two lateral grooves 33, 34.

In the first embodiment, it is preferable that the longitudinal groove 32 is within the range of 1–8 in number. It is much preferable that the number thereof is 1–6. It is preferable that the lateral grooves 33, 34 be within the range of 1–10 in number. It is much preferable that the number thereof is 2–7. The smaller the numbers of the longitudinal groove 32 and the lateral grooves 33, 34 is below the lower limits of the above ranges, the less the effects produced by the grooves 32, 33 and 34 are. As the numbers thereof increase over the upper limits of the above ranges, it becomes troublesome to manufacture the head covering 10. The number of the outer groove 31 needs not always to be only one. It is possible to provide one or plural second grooves a little smaller than the outer groove 31, substantially similar to the outer groove 31, formed substantially into an ellipse or an elongated circle, and coaxial with the outer groove 31. It is preferable that the number of the second grooves is within the range of 1–5. It is much preferable that the number is 1–3. The second grooves may be provided in lieu of the lateral grooves 33, 34. The grooves 31, 32, 33 and 34 can be formed at the same time when the liner 15 is foam-molded in a metal mold, or they can be formed by machining after the molding of the liner 15.

FIG. 5 is a projection representation, projected on horizontal plane 22, of the bottom surface of the impact absorbing liner 15 of the head covering 10 worn in the ordinary stance. According to FIG. 5, the outer groove 31 has substantially a similar shape to the space 21 of the head covering 10, occupied by the head, and capable of being substantially coaxial with the space 21. The other groove 31, the longitudinal groove 32 and the lateral grooves 33, 34 form substantially a lattice-like groove structure , so that many blockish projections 35, 36, 37, 38, 39, 40 form substantially matrix-like arrays. The grooves 31, 32, 33, 34 has a trapezoidal section which is narrow on the bottom side 43 and wide on the open side, that is, the groove width from the bottom side to the open side becomes gradually large, so that these projections 35, 36, 37, 38, 39, 40 are surrounded by the inclined side surfaces 42 (that is, they are also the annular inclined side surfaces of the projections 35, 36, 37, 38, 39, 40) and, further, the outer peripheries of the projections are surrounded by the bottoms 43 of the grooves 31, 32, 33, 34. Thus, the respective projections 35, 36, 37, 38, 39, 40 have separated independent island-shaped structures.

Figure 4:
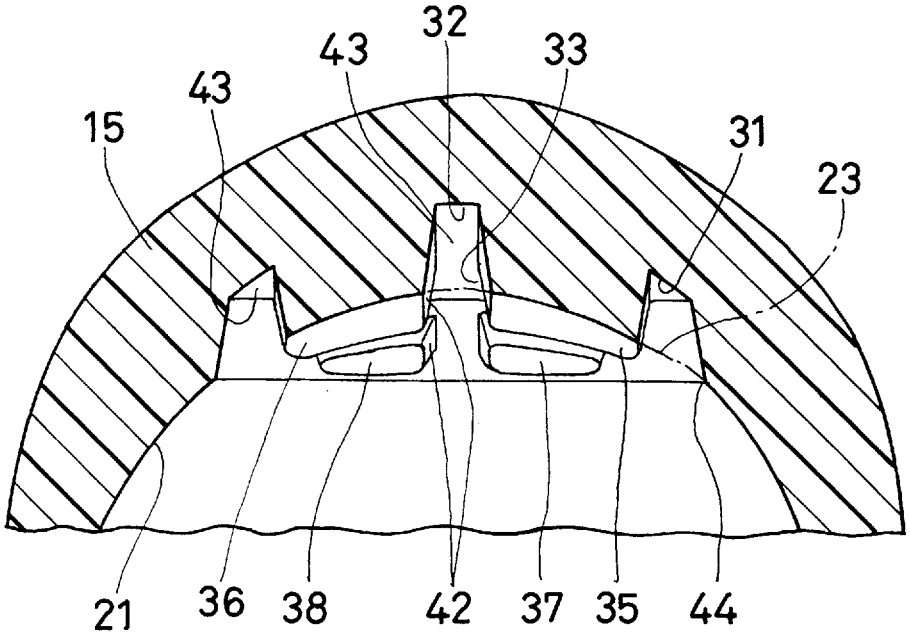
FIG. 4 is a longitudinal sectional view of an impact-on-the-head absorbing liner, taken along with the line C—C on FIG. 1.

Concretely speaking, the island-shaped projections 35, 36 have each the shape of a regular quadrangular frustum, and the island-shaped projections 37, 38, 39, 40 have each the shape of a regular triangular frustum. In the projection representation, it is preferable that the ratio between the distance (that is, the smallest distance) in the direction of its width (measured in the narrowest portion) and the distance (that is, the largest distance) in the direction of its length (measured in the longest portion) is within 3. It is much preferable that the ratio is within 2. The top surfaces of the projections 35, 36, 37, 38, 39, 40 may extend along the original inner surface 23 (substantially the hemispherical curved surface) as shown in FIGS. 3 and 4, or may protrude a little from the original inner surface 23 into the space 21. On the contrary, the top surfaces of the projections may sink below the original inner surface 23.

According to the first embodiment, substantially in the top portion of the liner 15 are the island-shaped projections 37, 38, 39, 40 arrayed into two lines along the longitudinal direction of the head covering 10 and three lines along the lateral direction thereof. In other words, the island-shaped projections 37, 38, 39, 40 form one line on the right side of and another line on the left side of the top portion or thereabout of the liner 15 and each line has three island-like projections. It is preferable that the number of lines along the longitudinal direction is 2–9. It is much preferable that the number is 2–7. Further, it is preferable that the number of lines along the lateral direction is 2–11. It is much preferable that the number is 3–8. The reason therefor is the same as the one for the number of the grooves 32, 33, 34. According to the drawings, the island-shaped projections 37, 38, 39, 40 are disposed in the right front portion (projection 37) of, in the left front portion (projection 38) of, in the right rear portion (projection 39) of and in the left rear portion (projection 40) of the top portion or thereabout of the inner surface of the liner 15, one by one. Generally speaking, it is preferable that their number is 1–15. It is much preferable that their number is 1–8. The reason therefor is the same as the one for the number of the grooves 32, 33, 34.

In the projection representation of FIG. 5, it is preferable that length $L_2$ along the longitudinal direction (vertical direction in FIG. 5) of the outer groove 31 (in other words, substantially lattice-like groove structures with grooves 31, 32, 33, 34), and length $W_2$ along the lateral direction (horizontal direction in FIG. 5) thereof are 40–80% of the longitudinal length $L_1$ of and the lateral length $W_1$ of the space 21 (that is $L_2/L_1$=0.4–0.8; $W_2/W_1$=0.4–0.8), respectively. It is much preferable that $L_2$ and $W_2$ are 50–70% of $L_1$ and $W_1$ (that is $L_2/L_1$=0.5–0.7; $W_2/W_1$=0.5–0.7). Thus, it becomes possible to provide the substantially lattice-like structure with grooves 31, 32, 33, 34 (in other words, projections 35, 36, 37, 38, 39, 40 set substantially in matrix-like arrays) in the head covering 10, so that the lattice-like structure may be to face substantially the rider or the like's vertex. From the standpoint of its utility, it is preferable that the longitudinal length $L_1$ of the space 21 is 190–250 mm. It is much preferable that $L_1$ is 205–235 mm. Further, it is preferable that the lateral length $W_1$ of the space 21 is 150–210 mm. It is much preferable that $W_1$ is 165–195 mm. Thus, it is preferable that length $L_2$ is 80–200 mm. It is much preferable that $L_2$ is 100–160 mm. Further, it is preferable that length $W_2$ is 60–160 mm. It is much preferable that $W_2$ is 85–135 mm.

As stated before, in the projection representation of FIG. 5, the outer periphery of the outer groove 31 (in other words, the outer periphery of the substantially lattice-like groove structure with grooves 31, 32, 33, 34) may be substantially similar in shape to the space 21 and substantially coaxial with the space 21. Therefore, length $L_3$ between the front end of the space 21 and the front end of the outer groove 31 may be substantially the same as length $L_4$ between the rear end of the space 21 and the rear end of the outer groove 31. Thus, it is preferable that the lengths $L_3$, $L_4$ are each 10–30% of the length $L_1$. It is much peferable that the lengths $L_3$, $L_4$ are each 15–25% thereof. Concretely speaking, it is preferable that they are 20–65 mm. It is much preferable that they are 30–55 mm.

Moreover, length $W_3$ between the left end (the right end in FIG. 5) of the space 21 and the left end of the outer groove 31 may be substantially the same as length $W_4$ between the right end of the space 21 and the right end of the outer groove 31. Therefore, it is preferable that the lengths $W_3$, $W_4$ are each 10–30% of the length $W_1$. It is much preferable that $W_3$, $W_4$ are each 15–25% thereof. Concretely speaking, it is preferable that $W_3$, $W_4$ are 10–60 mm in length. It is much preferable that they are 15–45 mm.

As a result of the forgoing, in the projection representation of FIG. 5, it is possible to inscribe the substantially lattice-like groove structure with grooves 31, 32, 33, 34 in an area surrounded by a predetermined closed curve 44. This closed curve 44 may substantially coincide with the outer periphery of the outer groove 31 (that is, the outer periphery of the outer inclined side surface of the outer groove 31). The closed curve 44 may have substantially the shape of the ellipse (including the circle) or the elongated circle. The closed curve 44 is inscribed in a predetermined rectangular area (including the square area), in which its longitudinal length is denoted by $L_2$ and its lateral length is denoted by $W_2$. This rectangular area is provided apart from the front end of the space 21 of the liner 15 in length $L_3$ and the rear end thereof in length $L_4$, and apart from the left end of the space 21 in width $W_3$ and the right end thereof in width $W_4$. Thus, the substantially lattice-like groove structure with grooves 31, 32, 33, 34 is formed only substantially in the top portion of the inner surface of the liner 15 and not formed substantially in the front portion, the right and left side portions and the rear portion of the inner surface of the liner 15, so that the formation of the grooves 31, 32, 33, 34 does not worthlessly cause the reduction of the rigidity (that is, the strength) of the whole of the liner 15.

It is preferable that the depths of the grooves 31, 32, 33, 34 (in other words, the distance between the respective bottoms of the grooves 31, 32, 33, 34 and the original inner surface 23 of the liner 15; in this embodiment, it coincides with the distance between the respective bottoms of the grooves 31, 32, 33, 34 and the respective top surfaces of the projections 35, 36, 37, 38, 39, 40) are smaller than a half of the thickness of the liner 15 and more than 5 mm. As stated before, it is preferable that the thickness of the liner 15 is 15–55 mm, and it is much preferable that it is 25–45 mm, so that it is preferable that the depths of the grooves 31, 32, 33, 34 are each 5–30 mm, and it is much preferable that they are each 10–20 mm. As the depths of the grooves 31, 32, 33, 34 increase over the above range, the rigidity of the whole of the liner 15 reduces, so that when an impact is exerted on the liner 15, the dispersion of the impact energy is insufficient. Thus, the bottoming phenomenon comes to the liner 15 due to the impact caused by the collision of a spherical or dully peaked object with the helmet, so that the maximum acceleration value will probably rise rapidly. On the contrary, as the depths of the grooves 31, 32, 33, 34 decrease over the above range, the effect of providing the grooves 31, 32, 33, 34 becomes gradually insufficient.

It is preferable that the widths of the grooves 31, 32, 33, 34 (they are not the widths of the bottoms 43 in here) in the projection representation of FIG. 5 are each within the range of 2–30 mm and it is much preferable that they are each within the range of 5–20 mm. As the widths of the grooves 31, 32, 33, 34 decrease lower than the above range, the effect of deforming the liner 15 along the surface of the rider's head becomes insufficient. On the contrary, as they increase over the above range, the rigidity of the whole of the liner 15 reduces.

As described above, since the substantially lattice-like groove structure with the grooves 31, 32, 33, 34 is formed in the inner surface of substantially the top portion of the liner 15 and, thereby, many projections 35, 36, 37, 38, 39, 40 are formed in matrix-like arrays, the liner 15 becomes easy to deform its configuration on its inner side in the any direction along the surface of the rider's head when the impact is exerted on the head covering 10, so that the impact energy can be effectively dispersed throughout the top portion of the liner 15 so as to be absorbed in the liner 15 and, also, can be effectively absorbed in the compressively deformed liner 15. Therefore, it is possible to reduce effectively the maximum acceleration exerted on the rider's head and to decrease the duration of continuation of the acceleration values that exceeds a predetermined value and, thereby, lower the HIC value.

Moreover, the liner 15 according to the first embodiment attains a higher degree of freedom on its deformation in the any direction along the surface of the rider's head, so that it is possible to form the liner 15 with higher density foam material as compared with the impact-on-the-head absorbing liner of the conventional head covering, in which grooves 31, 32, 33, 34 are not provided. Accordingly, even if the thickness of the liner 15 decreases due to the formation of grooves 31, 32, 33, 34, it does not occur to weaken the liner 15 against the impact caused by the collision with the spherical or dully peaked object. Further, the grooves 31, 32, 33, 34 are provided only in the top portion having the highest strength in the impact-on-the-head absorbing liner 15, so that it does not occur that the strength of the liner 15 worthlessly decreases as compared with a liner having such grooves also in its front portion and its right and left side portions, the strength of which is comparatively small.

In the first embodiment described above, the longitudinal groove 31 and the lateral grooves 32, 33 are substantially perpendicular to each other so as to form the substantially lattice-like groove structure. However, one or both of the longitudinal groove 31 and the lateral grooves 32, 33 may be changed to oblique grooves so as to intersect with each other at a moderate angle. When both the grooves are changed to the oblique grooves, respectively, it is preferable that both are slanted in opposite directions, respectively. Further, one or both of the longitudinal groove 31 and the lateral grooves 32, 33 can be changed to two kinds of oblique grooves which intersect with each other.

Example 1 of the head covering shown in FIGS. 1–5, according to the first embodiment of this invention, will be hereinafter described.

EXAMPLE 1

A glass fiber impregnated with unsaturated polyester is heated to polymerize in a metal mold in order to form a outer shell 12 whose thickness is 3 mm.

An impact-on-the-head absorbing liner 15 of foamed polystyren is formed, whose thickness is 37 mm and whose density is 47 g/lit. In the projection representation shown in FIG. 5, the longitudinal length $L_1$ and the lateral length $W_1$ of a space 21 of the liner 15, to be occupied by the rider's head are 20 mm and 180 mm, respectively. Formed in the top portion or thereabout of the inner surface of the liner 15 is a substantially lattice-like groove structure with outer groove 31, longitudinal groove 32 and lateral grooves 33, 34. In here, the longitudinal length $L_2$ of the groove structure (in other words, outer groove 31) is 150 mm ($L_2/L_1 \approx 0.68$), and the lateral length $W_2$ thereof is 120 mm ($W_2/W_1 \approx 0.56$). Further, lengths $L_3$ and $L_4$ are each 35 mm and lengths $W_3$ and $W_4$ are each 20 mm.

The depths of the grooves 31, 32, 33, 34, each having the shape of trapezoid in widthwise section, are 15 mm and the bottom widths 43 of the grooves 31, 32, 33, 34 (that is, the distance, on the bottom surface side, between a pair of inclined side surfaces 42 disposed on opposite sides of a bottom surface 43 of any one of the grooves 31, 32, 33, 34) is 10 mm. The widths on the open side of the grooves 31, 32, 33, 34 (that is, the distance, on the space 21 side, between the pair of the inclined side surfaces 42 disposed on the opposite sides of the bottom surface 43 of any one of the grooves 31, 32, 33, 34) is 15 mm.

The head covering of Example 1 is manufactured in such a way that the impact absorbing liner 15 is fitted into the outer shell 12.

One modification of Example 1, which is different from the first embodiment of this invention, will be hereinafter described.

EXAMPLE 2

A sheet formed by impregnating a glass fiber with polycarbonate is pressed in order to form a outer shell whose thickness is 3 mm.

An impact-on-the-head absorbing liner of foamed polystylene is manufactured, whose thickness is 35 mm and whose density is 42 g/lit. In a projection representation like FIG. 5, the longitudinal length $L_1$ of the space, occupied by the head, of this liner and the lateral length $W_1$ thereof are 220 mm and 180 mm, respectively. A groove structure of three straight longitudinal grooves, which are substantially parallel to one another, is formed substantially in the top portion of the inner surface of the liner. The pitch of the three longitudinal grooves (that is, the space between the central lines of the grooves adjacent to each other) is 25 mm. The central one among the three longitudinal grooves corresponds to longitudinal groove 32 shown in FIG. 1 and the remainder, the two right and left grooves, are arranged on the right and left sides of the central groove, respectively.

These three longitudinal grooves form two longitudinally extending projections between the grooves adjacent to each other. Since there is no groove at both the ends (that is, the front end and the rear end) of these projections, these projections exhibit not island-like structure but bridge-like structure. These three longitudinal grooves have each the similar shape of the trapezoid in section to the ones of the grooves 31, 32, 33, 34 shown in FIG. 1. The lengths of the three longitudinal grooves are each 140 mm, the depths thereof are each 15 mm, the bottom widths thereof are each 10 mm and the top widths thereof are each 15 mm.

In here, $L_2$ is 140 mm and $W_2$ is 65 mm, so that $L_2/L_1$ is nearly equal to 0.64 and $W_2/W_1$ is nearly equal to 0.36. $L_3$ and $L_4$ are each 40 mm, and $W_3$ and $W_4$ are each 57.5 mm.

The impact absorbing liner is fitted into the outer shell to manufacture the head covering of Example 2.

Comparable Examples 1–3 to be compared with Examples 1 and 2 of this invention will be hereinafter described.

COMPARABLE EXAMPLES 1–3

A head covering manufactured in the same way as the one disclosed in Example 1 except for not providing outer groove 31, longitudinal groove 32 and lateral grooves 33, 34 is designated as Comparable Example 1. A head covering manufactured in the same way as the one disclosed in Example 1 except for not providing outer groove 31, longitudinal groove 32 and lateral grooves 33, 34 and, further, setting the density of the impact-on-the-head absorbing liner for 42 g/lit. is designated as Comparable Example 2. Further, a head covering manufactured in the same way as the one disclosed in Example 2 except for not providing the three longitudinal grooves is designated as Comparable Example 3.

Thus, the head coverings disclosed in Comparable Examples 1–3 have each the shape of the semisphere in the inner surface of the impact-on-the-head absorbing liner. In other words, their shapes are each substantially the same as that of a virtual curved surface 23 shown in FIG. 3.

Impact absorbing tests made for the head covering of Examples 1 and 2 and Comparable Examples 1–3 will be hereinafter described.

Impact Absorbing Test

The head covering worn on a head dummy is made to freely fall down on a plane of steel from a height of 2.9 m, and the maximum acceleration, the period of duration of the acceleration over 150 G, and the HIC value thereof are calculated on the basis of the values measured by an accelerometer secured to the head dummy. G means gravitational acceleration and its value is 9.8 $m/s^2$.

The following table shows the result of the impact absorbing test in comparison between Examples 1, 2 and Comparable Examples 1–3.

| | Ex. 1 | Ex. 2 | Comp. Ex. 1 | Comp. Ex. 2 | Comp. Ex. 3 |
|---|---|---|---|---|---|
| Max. Acc. (G) | 195 | 186 | 217 | 203 | 220 |
| P. of Duration of Val. over 150 G (msec) | 3.74 | 3.94 | 3.98 | 4.05 | 3.98 |
| HIC | 1558 | 1671 | 2160 | 2050 | 2206 |

According to the table, it is apparent that the maximum acceleration and HIC of Examples 1 and 2 are lower than those of Comparable Examples 1–3.

A head covering shown in FIGS. 6–8 according to the second embodiment of this invention will be hereinafter described. It is noted that the description of the first embodiment holds good with the second embodiment except for the different points between them, which will be described below.

The head covering according to the second embodiment of this invention (FIG. 6–8) is only different from the head covering according to the first embodiment (FIGS. 1–5) in such a point that the groove structure formed in the impact-on-the-head absorbing liner 15, which comprises the backing member for the head, is different. The remaining structure may be substantially the same as that of the head covering shown in FIGS. 1–5. Therefore, the above remaining structure sometimes will not be explained and the same reference numbers will be used for the portions common between the two.

Figure 6:
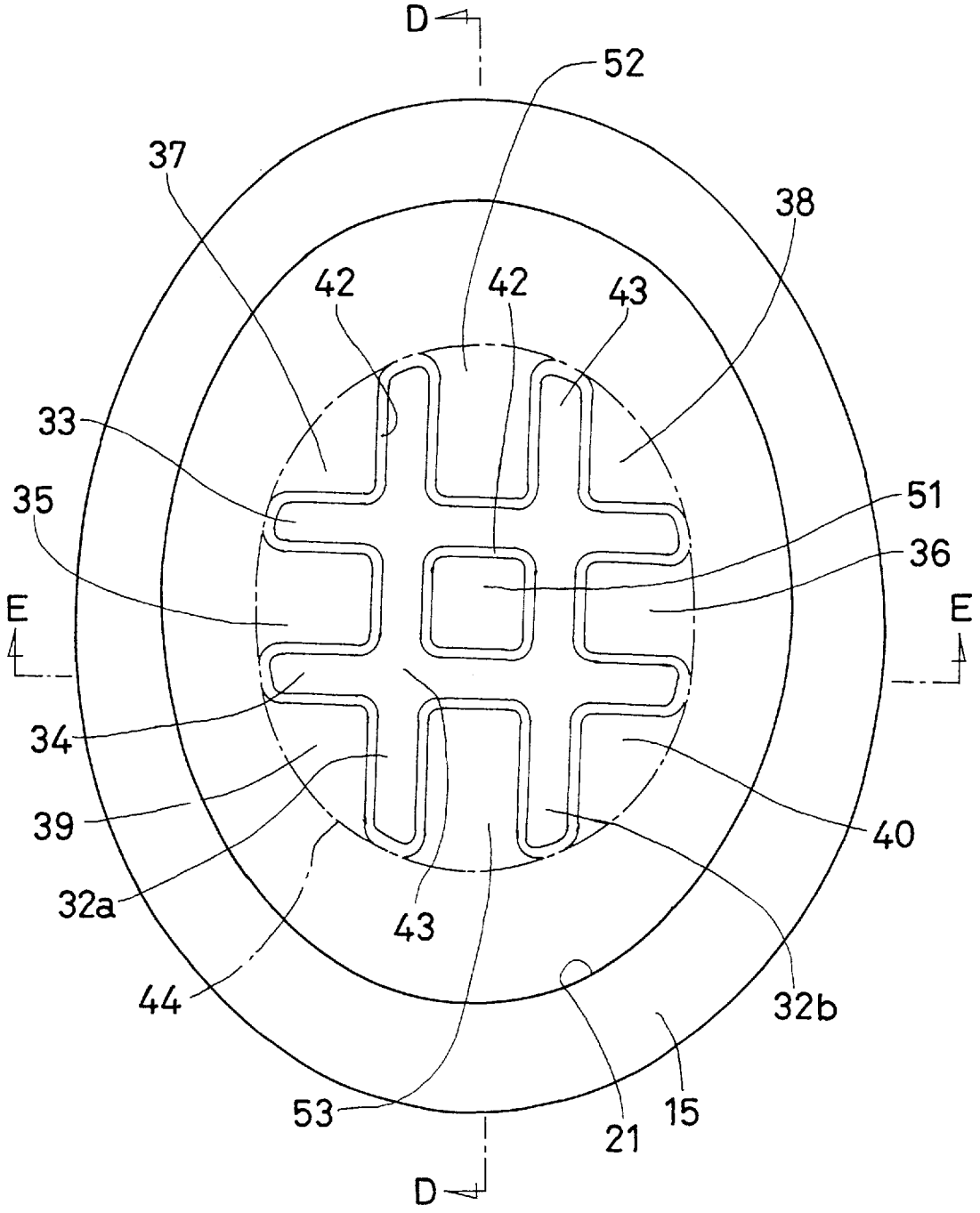
FIG. 6 is a projection representation, projected on the horizontal plane, of the bottom surface of the impact-on-the-head absorbing liner of the head covering according to another embodiment of this invention.

As shown in FIG. 6, the head covering according to the second embodiment is different from the head covering according to the first embodiment in such points that:

(1) the outer groove 31 is omitted, and (2) the number of the longitudinal groove 32 is changed from a single groove to two right and left grooves. The two longitudinal grooves 32*a*, 32*b* straightly extend in the longitudinal direction substantially perpendicularly to the lateral grooves 33, 34.

FIG. 6 is a projection representation, projected on the horizontal plane, of the bottom of the impact absorbing liner 15 of the head covering worn in the ordinary stance. As shown in FIG. 6, the substantially lattice-like structure formed by the longitudinal grooves 32*a*, 32*b* and the lateral grooves 33, 34 is inscribed in an area surrounded by virtual closed curve 44, the shape of which is substantially similar to that of the space 21, to be occupied by the head, of the liner 15 and which is substantially coaxial with the space 21. This closed curve 44 may be substantially the same as the outer periphery of the outer groove 31 according to the first embodiment.

Thus, the groove structure with grooves 32*a*, 32*b*, 33, 34 results in many blockish projections 35, 36, 37, 38, 39, 40, 51, 52, 53 being formed within the virtual closed curve 44 in matrix-like arrays. In FIG. 6, the projections 35, 36, 37, 38, 39, 40 correspond to the projections 35, 36, 37, 38, 39, 40 according to the first embodiment, respectively, though the former is a little smaller in lateral length than the latter. Further, the projections 51, 52, 53 are formed in line substantially along the longitudinal center line of the top portion of the liner 15. In addition, these projections 51, 52, 53 are substantially the same in shape as the projections 35, 36 in the projection representation shown in FIG. 6.

However, in the second embodiment, the outer groove 31 according to the first embodiment is omitted, so that the periphery of the projection 51 is completely surrounded by the grooves 32*a*, 32*b*, 33, 34 and it is of island-like shape, but the peripheries of the projections 35, 36, 37, 38, 39, 40, 52, 53 are surrounded by the grooves 32*a*, 32*b*, 33, 34 with the exception of one side thereof, each of which is of cape-like shape.

Even in the case of the second embodiment, a lot of blockish projections 35, 36, 37, 38, 39, 40, 51, 52, 53 are formed only substantially the top portion of the inner surface of the liner 15, so that the strength of the whole of the liner 15 is not lowered worthlessly. Nevertheless, when an impact is exerted on the head covering 10, the liner 15 is easily deformed in a desirable direction along the surface of the rider's head, so that it is possible to effectively disperse the impact energy throughout the top portion of the liner 15.

A head covering shown in FIGS. 9–11 according to the third embodiment of this invention will be hereinafter described. It is noted that the description of the first embodiment holds good with the third embodiment except for the following different points.

The head covering according to the third embodiment (FIGS. 9–11) is only different from the one according to the first embodiment, which is shown in FIGS. 1–5, in such a point that the groove structure formed in the impact-on-the-head absorbing liner 15, a back member for the head, differs from each other. The rest may be substantially the same as the head covering shown in FIGS. 1–5. Thus, the explanation of the rest will be sometimes omitted and the same reference numbers will be used for the portions common between the two.

Figure 9:
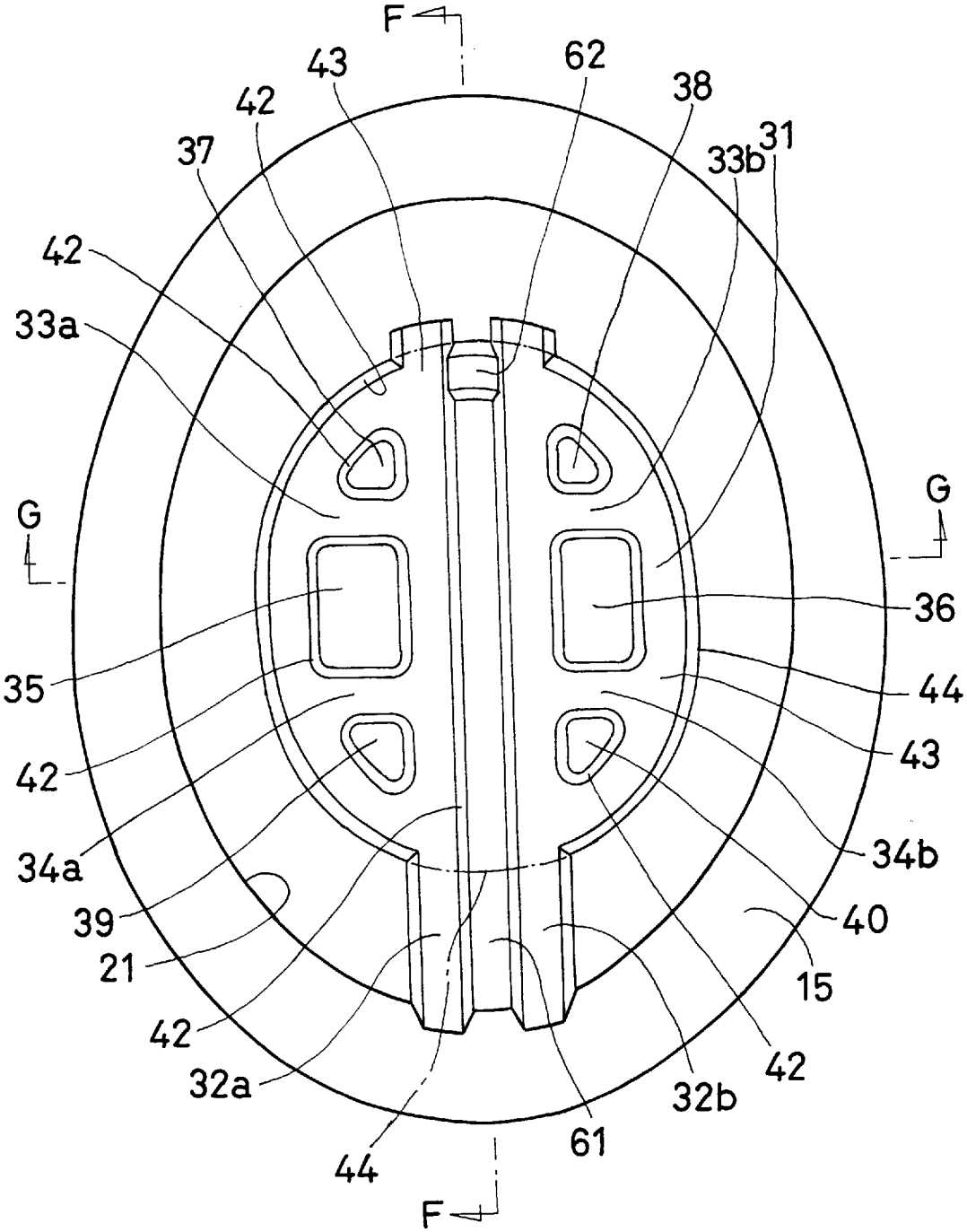
FIG. 9 is a projection representation, projected on the horizontal plane, of the bottom surface of the impact-on-the-head absorbing liner of the head covering according to a further embodiment of this invention.
Figure 12:
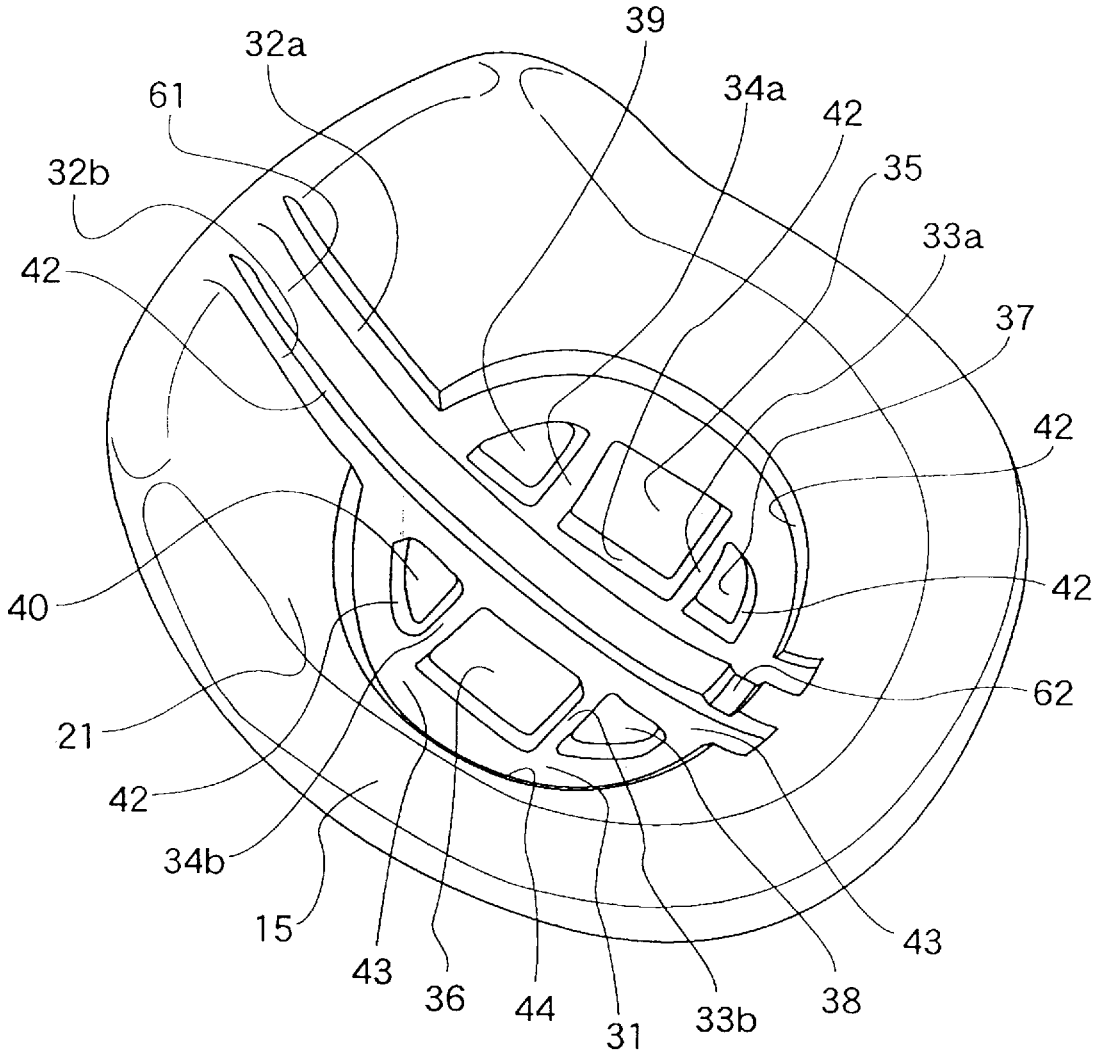
FIG. 12 is a perspective of the liner illustrated in FIG. 9.

As shown in FIG. 9, the head covering according to the third embodiment of this invention is different from the one according to the first embodiment in the following five points that:

(1) the number of the longitudinal groove 32 is changed from single to a couple of right one and left one;

(2) the respective rear ends of these right and left longitudinal grooves 32*a*, 32*b* are extended to the rear end of the space 21, to be occupied by the head, of the liner 15 (in other words, the lower end of the rear portion of the inner surface of the liner 15);

(3) the respective front ends of the right and left longitudinal grooves 32*a*, 32*b* are projected a little forwards (preferably in lengths of 5–30 mm, much preferably in lengths of 10–20 mm) from the outer groove 31;

(4) an elongated projection 61 extending straightly and longitudinally at the substantial center of the inner surface of the liner 15 is formed by and between the longitudinal grooves 32*a*, 32*b*; and (5) in order to make the elongated projection 61 island-like, a short lateral groove 62 for connection the two longitudinal grooves 32*a*, 32*b* is provided near the front ends (corresponding to the outer groove 31) of the longitudinal grooves 32*a*, 32*b*.

The two longitudinal grooves 32*a*, 32*b* and the elongated projection 61 divide the two lateral grooves 33, 34 into respective right and left portions 33*a*, 33*b*, 34*a*, 34*b*. Further, the longitudinal grooves 32*a*, 32*b* are extended to the rear end of the space 21, to be occupied by the head, of the liner 15 so that the elongated projection 61 is of the narrow island-like shape.

FIG. 9 is a projection representation, projected on the horizontal plane, of the bottom surface of the impact absorbing liner 15 of the head covering worn in the ordinary stance. It is apparent from FIG. 9 that most of the groove structure formed by the outer groove 31, longitudinal grooves 32*a*, 32*b* and lateral grooves 33*a*, 33*b*, 34*a*, 34*b* is inscribed in an area surrounded by the predetermined closed curve 44, which is substantially similar in shape to the space 21, to be occupied by the head, of the liner 15 and substantially coaxial thereof. The closed curve 44 may be substantially the same as the outer periphery of the outer groove 31, but the respective rear portions of the longitudinal grooves 32*a*, 32*b* extend, through the rear portion of the inner surface of the liner 15, to the lower end of the rear portion. The respective front portions of the longitudinal grooves 32*a*, 32*b* are projected a little from the closed curve 44 toward the front portion of the inner surface of the liner 15, but they are substantially within a desirable range, that is, within the predetermined rectangular area ($L_2 \times W_2$) shown in FIG. 5 and do not protrude into the front portion of the inner surface of the liner 15. Further, the rear portion of the elongated projection 61 formed between the longitudinal grooves 32*a*, 32*b* also extends, through the rear portion of the inner surface of the liner 15, to the lower end of the rear portion, so that most of the groove structure is provided substantially in the top portion of the inner surface of the liner 15, and only a part of the groove structure is provided in the rear portion of the inner surface of the liner 15.

Also in the case of the third embodiment, a lot of blockish projections 35, 36, 37, 38, 39, 40 are formed only substantially in the top portion of the inner surface of the liner 15 and the elongated projection 61 is formed in the top portion and the rear portion of the liner 15, so that the strength of the whole of the liner 15 is worthlessly lowered. Nevertheless, when an impact is exerted on the head covering, the liner is easily deformed in a desirable direction along the surface of the rider's vertex, so that it becomes possible to effectively disperse the impact energy throughout the top portion of the liner 15.

Having described a specific preferred embodiments of the present invention with reference to the accompanying drawings, it is to be understood that the invention is not limited to that precise embodiments, and that various changes and modifications may be effected therein by one skilled in the art without departing from the scope or spirit of the invention as defined in the appended claims.

For example, the helmet, to which this invention can be applied, is not limited to the jet-type ones according to the first to third embodiments. This invention can also be applied to the other types of safety helmet, such as semi-jet-type, full-face type or the like.

Moreover, in the first to third embodiments, the groove structure is formed only in the inner surface of the impact-on-the-head absorbing liner 15, but it may be formed also in the outer surface thereof. In that event, it is preferable that a half pitch shift is taken between the grooves formed in the outer surface and in the inner surface not only in the longitudinal direction but also in the lateral direction, when the substantially lattice-like grooves are formed. Further, it is preferable that the depth of the groove is rather shallow.

What is claimed is:

1. A head protector for a helmet, comprising an outer shell made of hard material and an impact-on-the-head absorbing liner arranged inside of said outer shell; wherein:

at least one groove is provided in a predetermined inner surface of the liner, the predetermined inner surface including at least a top portion to face the vertex of a person with a helmet on, but not substantially including at least a front portion to face the person's sinciput and, thereby, a plurality of projections at least partially surrounded by the groove are provided in the predetermined inner surface.

2. A head protector according to claim 1, wherein:

the predetermined inner surface includes only substantially a top portion of the inner surface of the liner.

3. A head protector according to claim 1, wherein:

a longitudinal length and a lateral length of the predetermined inner surface, both shown by a bottom view of the head protector, are each within 40–80% of a longitudinal length and a space, to be occupied by the person's head, of the liner;

a longitudinal length between a front end of the space to be occupied by the head and a front end of the predetermined inner surface, and a longitudinal length between a rear end of the space and a rear end of the predetermined inner surface, both shown by the bottom view of the head protector, are each within 10–30% of the lateral length of the space.

4. A head protector according to claim 1, wherein:

the at least one groove includes at least two grooves, one groove and another groove, which intersect with each other.

5. A head protector according to claim 4, wherein:

the one groove is the longitudinal groove and the other groove is the lateral groove.

6. A head protector according to claim 4, wherein:

the at least one groove further includes at least one outer groove, the one groove and the other groove extend within the area surrounded by the outer groove, and their both ends are connected with the outer groove.

7. A head protector according to claim 1, wherein:

the predetermined inner surface comprises only substantially both a top portion and a rear portion of the inner surface of the liner.

8. A head protector according to claim 1, wherein:

a lateral length of the predetermined inner surface, shown by a bottom view of the head protector is within 40–80% of a lateral length of a space, to be occupied by the person's head, of the liner, a longitudinal length of the predetermined inner surface shown by the bottom view of the head protector is within 70–90% of the longitudinal length of the space, a longitudinal length between a front end of the space and a front end of the predetermined inner surface shown by the bottom view of the head protector is within 10–30% of the longitudinal length of the space, and a lateral length between a left end of the space and a left end of the predetermined inner surface, and lateral length between a right end of the predetermined inner surface shown by the bottom view of the head protector are each within 10–30% of the lateral length of the space.

9. A head protector according to claim 7, wherein:

the at least one groove includes at least two grooves comprising one groove and another groove, which intersect with each other.

10. A head protector according to claim 9, wherein:

the at least one groove further includes at least one outer groove;

the one groove is formed with longitudinal groove extending substantially over the total length of both the top portion and the rear portion of the inner surface of the liner;

the other groove is formed with lateral groove intersecting with the longitudinal groove; and the lateral groove extends in an area surrounded by the outer groove, at least one end of each lateral groove being connected to the outer groove.

11. A head protector according to claim 1, wherein:

the plurality of projections include a plurality of block-like projections, in which the maximum length of the projection is within three times as large as the minimum length thereof.

12. A head protector according to claim 11, wherein:

the respective blockish projections are of island shape.

13. A head protector according to claim 11, wherein:

some of the block-like projections have each an island shape and some other project each as a peninsula or a promontory.

14. A head protector according to claim 11, wherein:

the plurality of projections further include an elongated projection shaped like an embankment.

15. A head protector according to claim 1, wherein:

the number of the plurality of projections is within 4–60.

16. A head protector according to claim 1, wherein:

the depth of the groove is smaller than a half thickness of the liner and larger than 5 mm; and the width of the groove is within 2–30 mm.

17. A head protector according to claim 1, wherein:

the groove is narrow on a bottom side thereof and gradually widens toward an open side thereof.

18. A head protector according to claim 1, wherein:

a longitudinal length and a lateral length of the predetermined inner surface, both shown by a bottom view of the head protector, are each within 50–70% of a longitudinal length and a lateral length of a space, to be occupied by the person's head, of the liner;

a longitudinal length between a front end of the space to be occupied by the head and a front end of the predetermined inner surface, and a longitudinal length between a rear end of the space and a rear end of the predetermined inner surface, both shown by the bottom view of the head protector, are each within 15–25% of the longitudinal length of the space; and a lateral length between a left end of the space and a left end of the predetermined inner surface, and a lateral length between a right end of the space and a right end of the predetermined inner surface, both shown by the bottom view of the head protector, are each within 15–25% of the lateral length of the space.

19. A head protector according to claim 1, wherein:

a lateral length of the predetermined inner surface, shown by a bottom view of the head protector is within 50–70% of a lateral length of a space, to be occupied by the person's head, of the liner, a longitudinal length of the predetermined inner surface shown by the bottom view of the head protector is within 75–85% of the longitudinal length of the space, a longitudinal length between a front end of the space and a front end of the predetermined inner surface shown by the bottom view of the head protector is within 15–25% of the longitudinal length of the space, and a lateral length between a left end of the space and a left end of the predetermined inner surface, and a lateral length between a right end of the space and a right end of the predetermined inner surface shown by the bottom view of the head protector are each within 15–25% of the lateral length of the space.

20. A head protector according to claim 1, wherein: the plurality of projections include a plurality of block-like projections, in which the maximum length of the projections is within two times as large as the minimum length thereof.

21. A head protector according to claim 1, wherein:

the number of the plurality of projections is within 6–30.

22. A head protector according to claim 1, wherein:

the depth of the groove is smaller than a half thickness of the liner and falls within the range of 10–20 mm., and the width of the groove is within 5–20 mm.

* * * * *